US012467272B2

(12) United States Patent
Gibson

(10) Patent No.: US 12,467,272 B2
(45) Date of Patent: Nov. 11, 2025

(54) LIGHTWEIGHT COLUMBARIUM, COMBINATIONS THEREOF WITH A RITUAL TRANSPORTER AND A CRATE, AND METHODS OF TRANSPORTING AND INSTALLING A LIGHTWEIGHT COLUMBARIUM

(71) Applicant: GESTION MORIN ET GIBSON INC., Rouyn-Noranda (CA)

(72) Inventor: Normand Gibson, Rouyn-Noranda (CA)

(73) Assignee: GESTION MORIN ET GIBSON INC., Rouyn-Noranda (CA)

( * ) Notice: Subject to any disclaimer, the term of this patent is extended or adjusted under 35 U.S.C. 154(b) by 326 days.

(21) Appl. No.: 18/010,734

(22) PCT Filed: Jun. 15, 2020

(86) PCT No.: PCT/CA2020/050830
§ 371 (c)(1),
(2) Date: Dec. 15, 2022

(87) PCT Pub. No.: WO2021/253110
PCT Pub. Date: Dec. 23, 2021

(65) Prior Publication Data
US 2023/0265675 A1 Aug. 24, 2023

(51) Int. Cl.
*E04H 13/00* (2006.01)

(52) U.S. Cl.
CPC ..... *E04H 13/006* (2013.01)

(58) Field of Classification Search
CPC ..... E04H 13/006
(Continued)

(56) References Cited

U.S. PATENT DOCUMENTS 3,754,805 A * 8/1973 Pangburn ..... F16B 12/18 211/84
5,195,812 A 3/1993 Eickhof
(Continued)

FOREIGN PATENT DOCUMENTS

DE 102011052550 A1 2/2013
JP 2014141850 A 8/2014
(Continued)

*Primary Examiner* — James J Buckle, Jr.
(74) *Attorney, Agent, or Firm* — Jacob M. Ward; Ward Law Office LLC

(57) ABSTRACT

The lightweight columbarium comprises a rigid frame made of a frame material, a number of decorative panels made of a decorative panel material, panel attachments for attaching the decorative panels to the rigid frame, and an enclosure defined within said decorative panels and said frame, for receiving a funeral urn. The frame material is less fragile than the decorative panel material and allows the frame to provide structural rigidity to the columbarium at less weight than if only the decorative panel material were used. The columbarium may be transported on a ritual transporter comprising a columbarium bed for carrying the columbarium and handles attached to the columbarium bed for transporting the transporter. The columbarium may be stored in a crate comprising a rigid protective shell attached to the columbarium externally thereof for protecting the columbarium against impacts; and an opening provided in the protective shell that is aligned with the bottom of the columbarium. The columbarium may be removed from the crate and installed on a base using a prop sized to fit within a shell opening in the crate so as to abut against the bottom of the columbarium and to protrude beyond the shell, for allowing the columbarium to rest on prop when the prop rests on the ground for facilitating egress of the columbarium from the crate and installation of the columbarium on the base.

3 Claims, 14 Drawing Sheets

(58) Field of Classification Search
USPC ..... 52/134
See application file for complete search history.

(56) References Cited

U.S. PATENT DOCUMENTS 5,466,057 A * 11/1995 Blankenburg ..... A47B 87/005 312/111
5,477,594 A * 12/1995 LePage ..... E04H 13/006 211/84
5,865,334 A * 2/1999 Ruiz ..... B65D 85/48 206/451
5,894,699 A * 4/1999 Fulton ..... E04H 13/006 52/134
5,979,124 A * 11/1999 Branan ..... E04H 13/006 52/489.1
6,250,025 B1 * 6/2001 Darby ..... E04H 13/006 52/142
9,414,985 B2 * 8/2016 Ugartechea Berlanga ..... A61G 99/00
10,422,151 B1 * 9/2019 Garcia ..... E04H 13/008
2009/0229197 A1 * 9/2009 Bach Lahor ..... E04H 13/006 52/142
2010/0300016 A1 * 12/2010 Eickhof ..... E04H 13/006 52/587.1
2012/0042489 A1 * 2/2012 Cai ..... E04H 13/006 27/35
2013/0086780 A1 * 4/2013 Grover ..... A61G 21/00 27/27
2015/0308141 A1 * 10/2015 Ugartechea Berlanga ..... E04H 13/008 52/135
2018/0202184 A1 * 7/2018 Rossi ..... E04H 13/008
2018/0223558 A1 * 8/2018 Birkmeier ..... E04H 13/008
2018/0283035 A1 * 10/2018 Mercer ..... E05B 65/0057

FOREIGN PATENT DOCUMENTS

JP 3193315 U 9/2014
WO 9635850 A1 11/1996
WO 9936646 A1 7/1999

* cited by examiner

LIGHTWEIGHT COLUMBARIUM, COMBINATIONS THEREOF WITH A RITUAL TRANSPORTER AND A CRATE, AND METHODS OF TRANSPORTING AND INSTALLING A LIGHTWEIGHT COLUMBARIUM

CROSS-REFERENCE TO RELATED APPLICATIONS

This patent application is a United States National Stage of International Patent Application No. PCT/CA2020/050830, filed Jun. 15, 2020. The entire disclosure of the above patent application is incorporated herein by reference.

FIELD OF THE INVENTION

The present invention relates to the field of funeral equipment, and more particularly to columbariums, and to methods of transporting and storing columbariums.

BACKGROUND OF THE INVENTION

There is a deep spiritual process associated to the passing away of loved ones—religious or not—and the rituals that follow the passing away of a person hold a high importance and are an essential step in the mourning. There are different funeral rituals according to countries and cultures. One of those rituals includes to burn the body of the deceased, to pour the ashes in a funeral urn, and to store the urn in a columbarium where it will rest in a cemetery.

A columbarium is consequently essentially a decorative and protective box for the funeral urn, but its spiritual aspect is important since many persons will visit the cemetery where the columbarium, and the funeral urn, are exposed. There are rules and restrictions imposed by the cemetery administrations, regarding the composition of columbariums, notably to avoid the peaceful environment in cemeteries to be disturbed by chaotic stylistic deviations. Among those restrictions, is the materials used to make a columbarium: these should be made exclusively or in large part of stone, granite or marble, possibly with minor artistic intrusions of noble metals such as bronze for example.

The result however is that the columbarium, even if only required to house a relatively small funeral urn, is so heavy as to require a lift truck or a crane to displace it, including bringing the columbarium to the funeral ground. This means that during the funeral rite that consists in bringing the urn to its final resting place, the columbarium normally needs to be installed in advance; and the cemetery administration needs to intervene to install the columbarium, which adds costs to the process.

SUMMARY OF THE INVENTION

The present invention relates to a lightweight columbarium, comprising:

a rigid frame made of a frame material;

a number of decorative panels made of a decorative panel material;

panel attachments for attaching the decorative panels to the rigid frame; and an enclosure defined within said decorative panels and said frame, for receiving a funeral urn;

wherein the frame material is less fragile than the decorative panel material and allows the frame to provide structural rigidity to the columbarium at less weight than if only the decorative panel material were used.

In one embodiment, the frame material comprises one or more of a metal, a metallic alloy, graphite, carbon fibre, and a plastic; and the decorative panel material comprises one or more of stone, marble, granite, lexan and glass.

In one embodiment, the enclosure is defined within the frame, and the decorative panels, the frame or both include a door that can be opened to access the enclosure.

In one embodiment, the panel attachments include flanges disposed outside of the enclosure to receive at least some of the decorative panels, and fasteners to fasten at least some of the decorative panels to the frame; and wherein the flanges include exposed portions that are visible externally of the columbarium.

In one embodiment, the door includes a transparent wall.

The present invention also relates to the combination of a lightweight columbarium as described above, and a ritual transporter, the ritual transporter comprising a columbarium bed for carrying the columbarium and handles attached to the columbarium bed for transporting the transporter.

In one embodiment, the handles comprise a pair of spaced-apart side rails carrying said columbarium bed therebetween.

In one embodiment, the ritual transporter further comprises an urn bed carried between the side rails for carrying a funeral urn externally of the columbarium.

In one embodiment, the ritual transporter further comprises columbarium attachments for releasably attaching the columbarium to the transporter.

The present invention also relates to a method of transporting the lightweight columbarium described above with the ritual transporter described above, the method comprising the steps of:

disposing the columbarium on the columbarium bed; and manually transporting the ritual transporter with the transporter handles while exposing the columbarium.

In one embodiment, the method further comprising, after the step of disposing the columbarium on the columbarium bed, releasably attaching the columbarium to the ritual transporter.

In one embodiment, the ritual transporter further comprises an urn bed attached to the columbarium bed, the method further comprising disposing a funeral urn on the urn bed externally of the columbarium, to expose the funeral urn separately from the columbarium.

The present invention further relates to the combination of the lightweight columbarium described above, with a crate and a prop, the columbarium defining a top and a bottom, the crate comprising:

a rigid protective shell attached to the columbarium externally thereof for protecting the columbarium against impacts; and an opening provided in the protective shell that is aligned with the bottom of the columbarium;

wherein the prop is sized to fit within the shell opening so as to abut against the bottom of the columbarium and to protrude beyond the shell, for allowing the columbarium to rest on prop when the prop rests on the ground for facilitating egress of the columbarium from the crate and installation of the columbarium on a base.

In one embodiment, the rigid shell comprises a number of shell panels and shell panel attachments securing the shell panels against the columbarium.

In one embodiment, the shell is made from a shell material comprising one or more of wood and plastic.

The invention also relates to a method of installing on a base the lightweight columbarium described above stored in the crate described above, the method comprising the steps of:

providing a prop sized to fit within the shell opening and thicker than the shell;

placing the prop on the base;

placing the columbarium stored in the crate on the prop such that the bottom of the columbarium rests on the prop, with the prop extending through the opening in the crate and protruding beyond the shell;

removing the shell from the columbarium at least partly while the columbarium rests on the prop; and removing the prop from underneath the columbarium to have the columbarium rest directly on the base.

In one embodiment, the step of removing the shell from the columbarium comprises removing a number shell panels by releasing shell panel attachments securing the shell panels against the columbarium.

In one embodiment, the step of releasing shell panel attachments comprises cutting attachment straps that maintain the shell panels against the columbarium.

In one embodiment, the method further comprises, before the step of removing the prop from underneath the columbarium, rocking the columbarium on one side until the bottom of the columbarium rests on the base and the weight of the columbarium is removed from the prop.

In one embodiment, the method further comprises, after the step of removing the shell but before the steps of rocking the columbarium on one side and of removing the prop, the steps of:

rocking the columbarium on another side opposite the one side until access to the bottom of the columbarium is obtained; and applying a first portion of an adhesive between the base and the bottom of the columbarium while the columbarium is rocked on the other side; then, before the step of removing the prop from underneath the columbarium but after the step of rocking the columbarium on the one side:

applying a second portion of the adhesive between the base and the bottom of the columbarium while the columbarium is rocked on the one side.

DETAILED DESCRIPTION OF THE EMBODIMENTS

Figure 1:
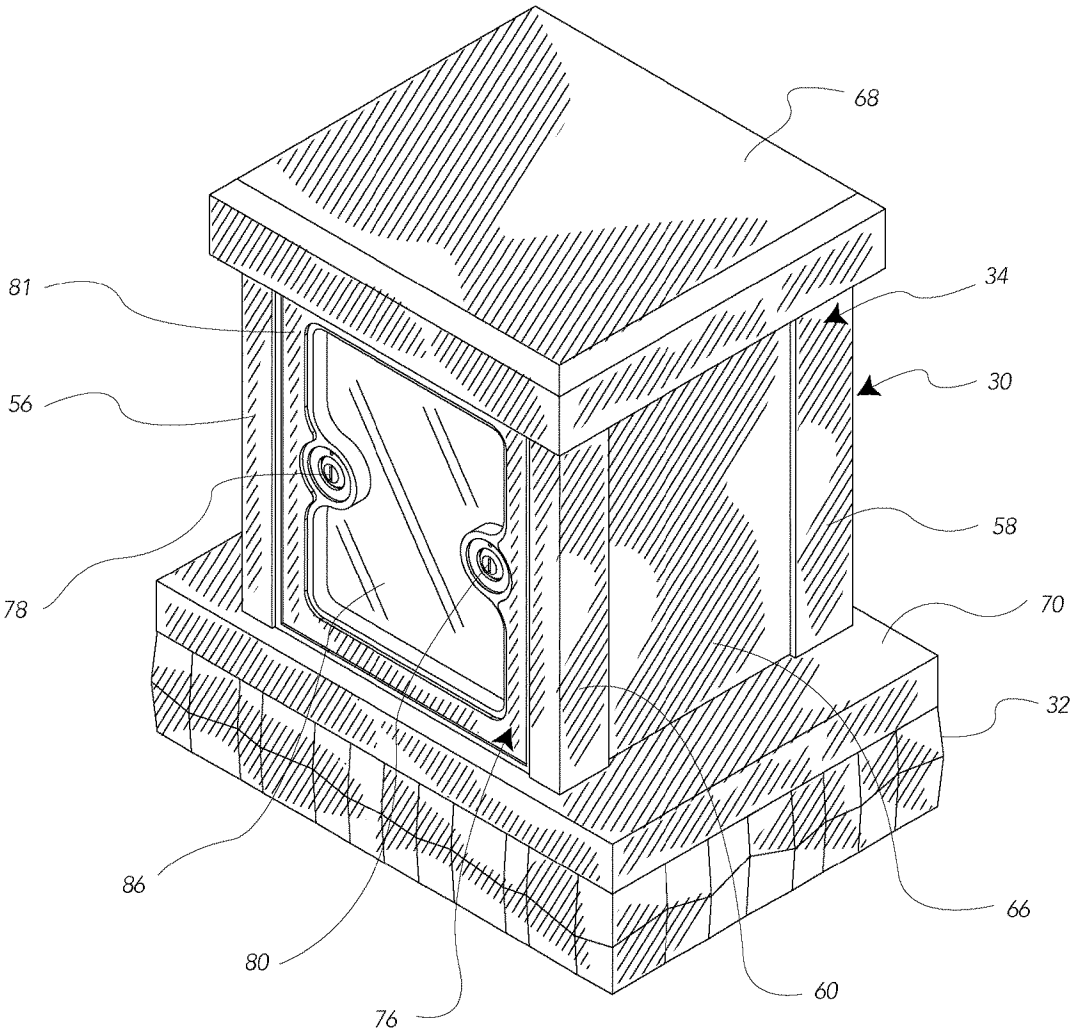
FIGS. 1 and 2 are respectively a perspective view and an exploded perspective view of the columbarium according to a first embodiment of the present invention, mounted on a base.
Figure 2:
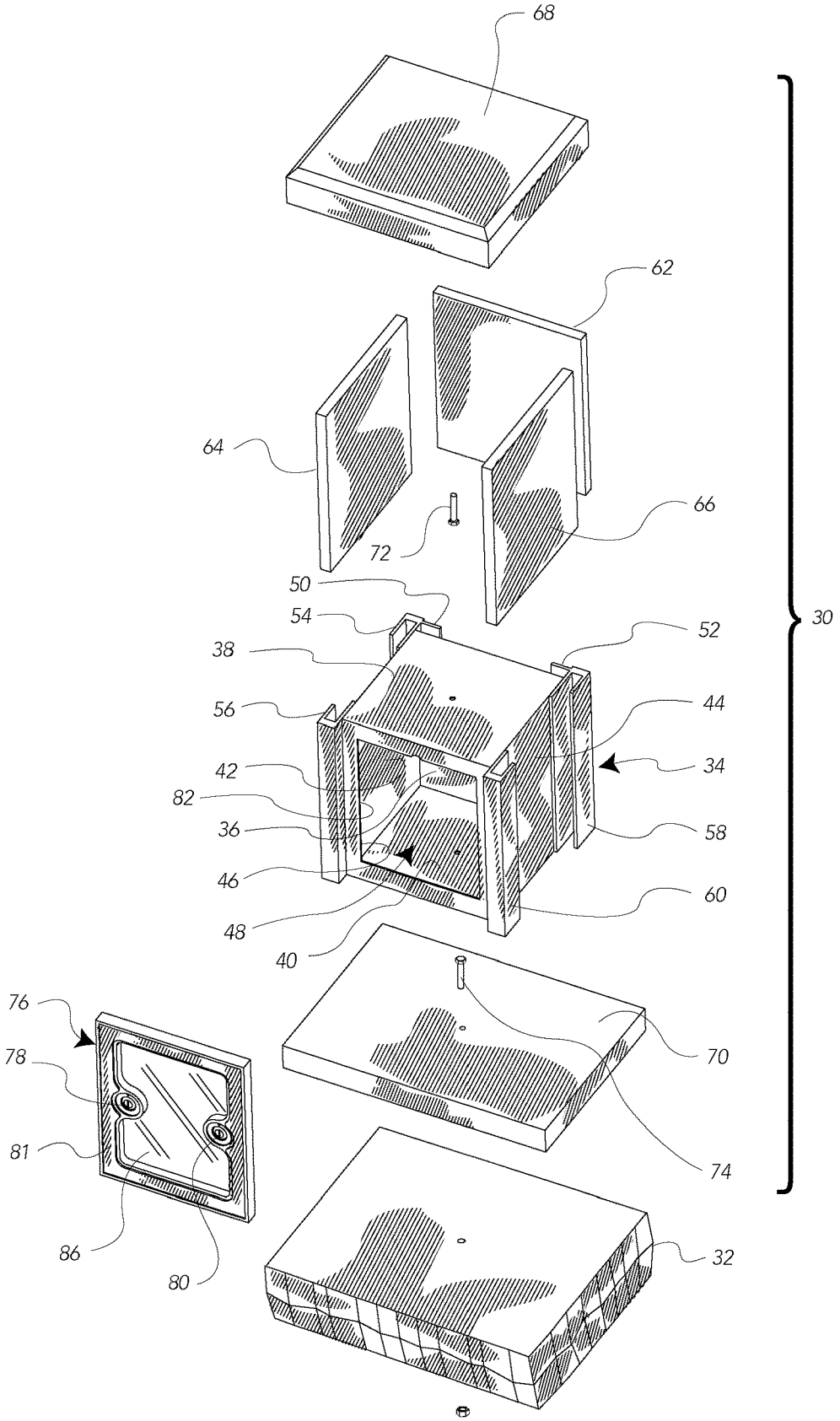

FIGS. 1 and 2 show a lightweight columbarium 30 according to the present invention, that is traditionally installed on a base 32 formed of a slab or stone or other suitable support structure which is normally provided on funeral grounds.

Columbarium 30 comprises a rigid frame 34 that includes a back wall 36, top and bottom walls 38, 40, two side walls 42, 44 that are fixedly attached (e.g. welded) to each other. Frame 34 also comprises a front opening 46 allowing access into an enclosure 48 defined between walls 36, 38, 40, 42, 44 for receiving a funeral urn (not shown) therein.

Frame 34 further comprises three pairs of flanges 50, 52; 54, 56; and 58, 60 that are fixed (e.g. welded) to the external surface of back and side walls, 36, 40, 42 so as to be disposed on the external surface of frame 34, externally of enclosure 48. Each flange 50, 52, 54, 56, 58, 60 is C-shaped and faces the other flange in its pair of flanges, to receive and retain a respective one of a rear decorative panel 62 and two side decorative panels 64, 66 10 that each snugly fits between a corresponding one of the pairs of flanges 50, 52; 54, 56 and 58, 60. Top and bottom decorative panels 68, 70 are fixed to frame 34 by means of top and bottom fasteners in the form of bolts 72, 74, and since they are larger than frame 34, they prevent the rear and side decorative panels 62, 64, 66 from sliding out of flanges 50, 52; 54, 56 and 58, 60.

Columbarium 30 also comprises a front panel 76 that forms a door that can be opened to access enclosure 48. Front panel 76 is equipped with locking members 78, 80 on a peripheral sash 81 in the form of cams that are engeable with a front flange 82 on frame 34 such that front panel 76 may be releasably attached to frame 34 to either close or allow access into enclosure 48. Keys (not shown) can be used to lock or locking members 78, 80. Front panel 76 includes a transparent pane 86 to allow visual access into enclosure 48 to see a funeral urn that would be exposed therein.

In one embodiment (not show), the front panel would be made of the same material as that of the other decorative side, rear, bottom and top panels, namely stone, granite or marble. It would still be possible to lock and open this front panel, e.g. with a dedicated key.

As shown in FIG. 1, exposed portions of flanges 50, 52, 54, 56, 58, 60 are visible externally of columbarium 30, between the decorative panels 62, 64, 66, 68, 70, 76, which allows them to contribute to the visual appearance of columbarium 30. Particularly, the exposed portions of flanges 50, 52, 54, 56, 58, 60 may be engraved or otherwise ornamented.

Other panel attachments (not shown), in addition to, or instead of, flanges 50, 52, 54, 56, 58, 60; bolts 72, 74; and locking members 78, 80; could be used for attaching the decorative panels 62, 64, 66, 68 70, 76 to rigid frame 34.

Frame 34 is made of a frame material that is less fragile than the materials of decorative panels 62, 64, 66, 68 70, 76 and that allows the frame to provide structural rigidity to the columbarium at less weight than if only the decorative panel material were used. For example, the frame material comprises one or more of a metal such as bronze, silver, gold, tin, aluminium or another metal, a metallic alloy that could include some of these metals in combination with others, graphite, carbon fibre, and a rigid plastic that has the required mechanical properties required to retain the decorative panels. The decorative panel material comprises one or more of stone, marble, granite, lexan and glass. Normally, the decorative panels are mostly composed of stone, marble or granite, but some panels such as the door that are transparent would obviously include other materials such as lexan. The door may also include metals or metallic alloys or other suitable materials.

The result is that columbarium 30 is of light weight compared to conventional columbariums that are normally entirely composed of granite, stone or marble. The external exposed surface of the columbarium 30 being made of granite, stone or marble meets expectations, and rules, relating to the type of material for columbariums. Columbarium 30 is of lightweight while still respecting the materials, by providing the exterior decorative panels 62, 64, 66, 68 70, 76 in these materials, while allowing the inner frame to be less fragile and resistant but of overall lighter weight.

The resultant lightweight columbarium 30 may be thus be transported for example by two or even a single person, while this is unthinkable in the case of conventional heavy columbariums made entirely of stone, marble or granite, that require a lift truck, crane or other lift vehicle to be used to transport the columbarium.

Figure 3:
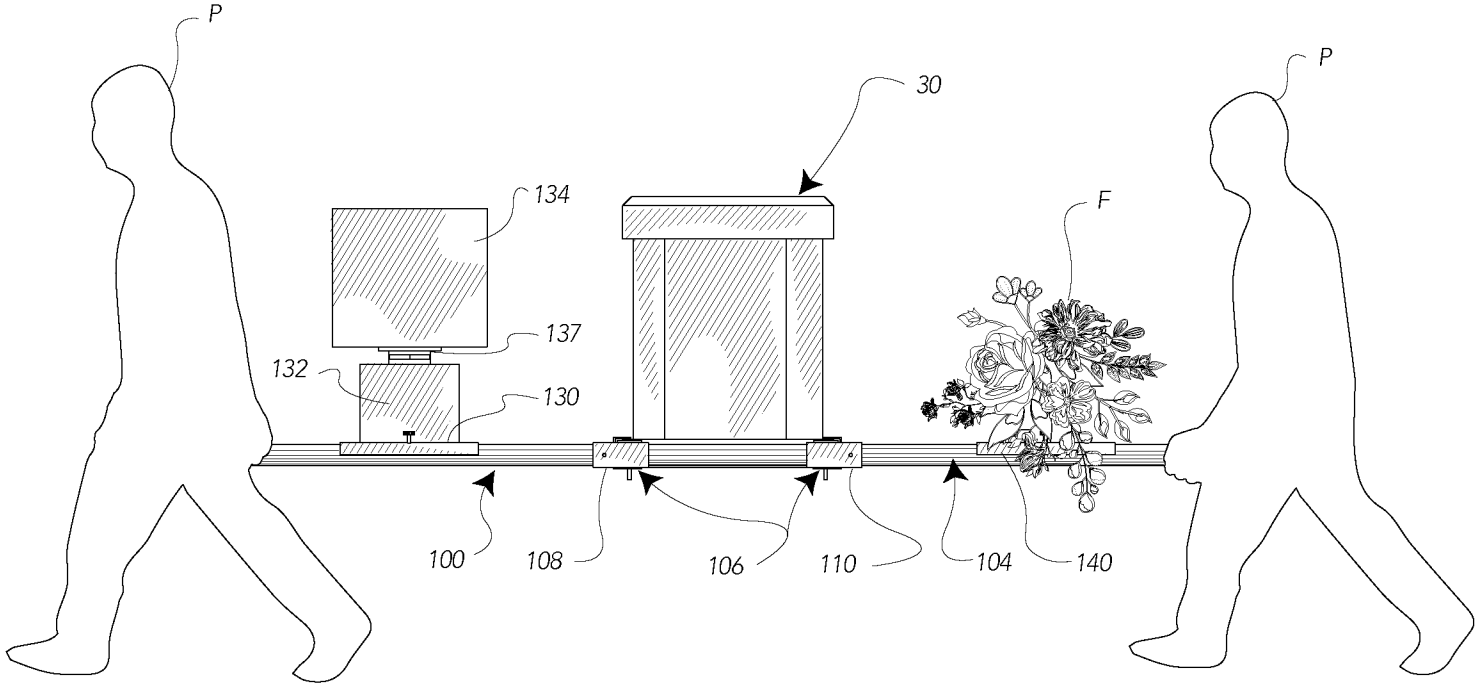
FIG. 3 is a side elevation of the columbarium of FIGS. 1-2, installed on a ritual transporter according to the invention that also carries a funeral urn and flowers.
Figure 4:
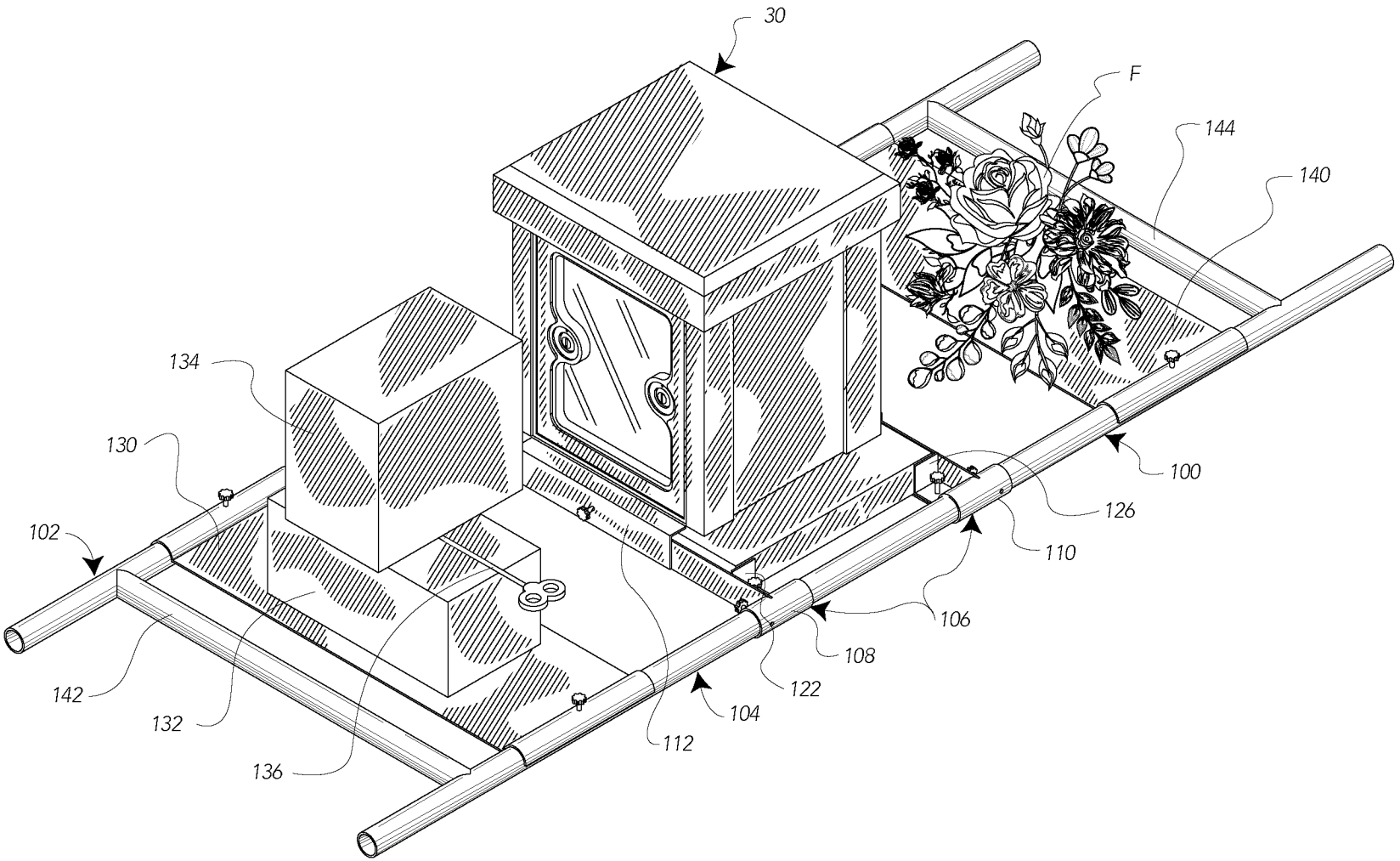
FIGS. 4 and 5 are respectively a perspective view and an exploded perspective view of the ritual transporter, columbarium and urn of FIG. 3, with the flowers removed in FIG. 5.
Figure 5:
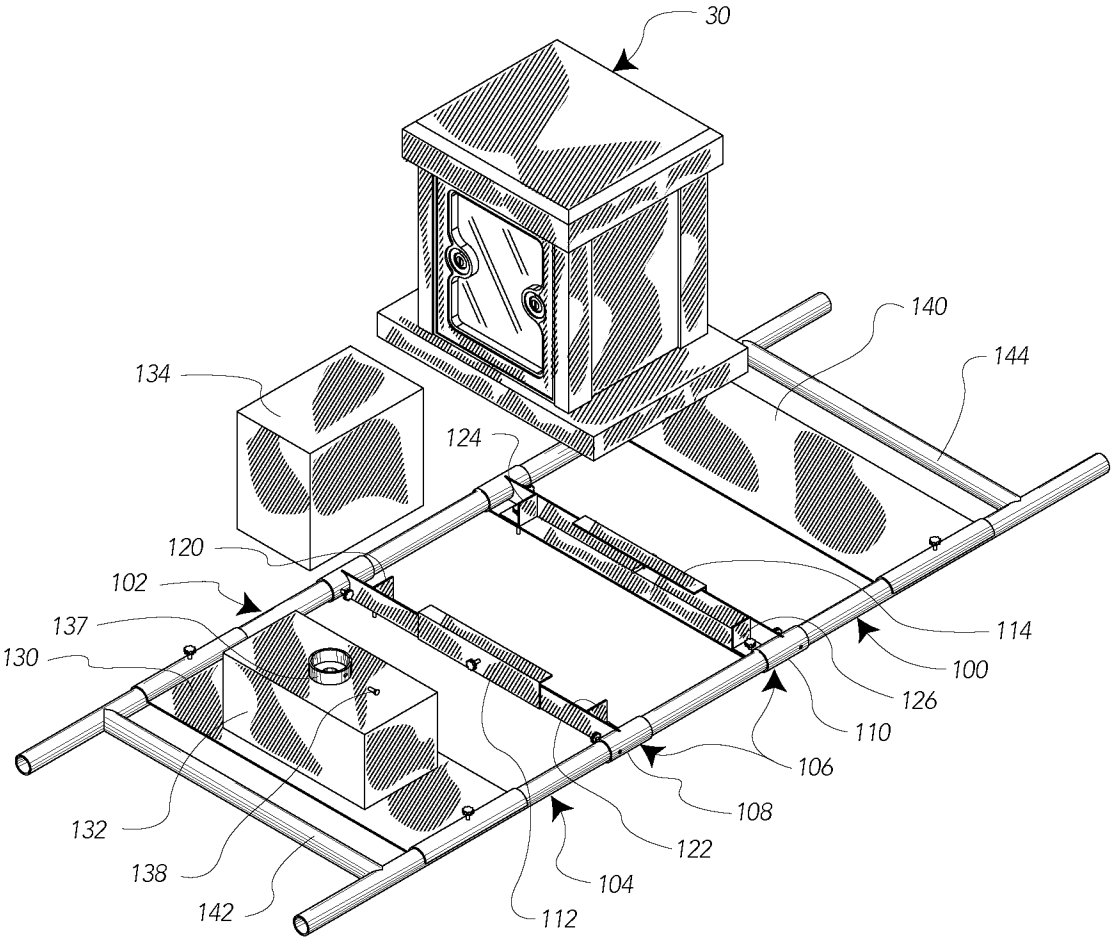

One way to take advantage of the lightweight columbarium 30 is to use a manually transportable ritual transporter 100 to transport the columbarium, as shown in FIGS. 3, 4 and 5. Ritual transporter 100 comprises a pair of spaced-apart side rails 102, 104 that extend longitudinally of transporter 100, and a columbarium bed 106 extending between side rails 102, 104 for carrying columbarium 30 thereon. Columbarium bed 106 comprises two L-shaped support members 108, 110 that are fixed to and that extend transversely between side rails 102, 104 and that each include columbarium attachments in the form of C-shaped attachment plates 112, 114 that engage the protruding edges of columbarium bottom wall 70 and that are releasably fixed thereagainst with a number of set screws for releasably attaching columbarium 30 to transporter 100. Columbarium attachments also include iron angles 120, 122, 124, 126 attached with set screws to support members 108, 110 to allow the position of columbarium 30 to be laterally fixed.

Transporter bed 106 could of course include a full underlying plate instead of spaced-apart support members 108, 110, but it would then be heavier.

Transporter 100 further comprises an urn bed 130 that is formed of a flat plate fixed to and carried between side rails 102, 104 on top of which there is provided a funeral urn pedestal 132 for carrying a funeral urn 134. A key 136 is used to releasably attach urn 134 to pedestal 132 by means of an interlocking socket 137 and a set screw 138.

A flower bed 140 is fixed to and carried between side rails 102, 104 to allow flowers F to be exposed on transporter 100.

A pair of crossbars 142, 144 that are fixed to and carried between side rails 102, 104 reinforce transporter 100.

Side rails 102, 104 and crossbars 142, 144 can be used as handles to carry transporter 100, for example two persons P could hold the front and rear extremities of side rails 102, 104 for transporting transporter 100 as shown in FIG. 3.

According to the present invention, there is provided a method of transporting a lightweight columbarium 30 with a ritual transporter 100, that comprises the steps of disposing the columbarium on the columbarium bed 106; and manually transporting the ritual transporter 100 with the transporter handles while exposing the columbarium. The manual transportation of columbarium 30 would not be possible if it were not lightweight as detailed hereinabove. This is especially true since the transporter 100 itself has additional weight that needs to be taken into account in the total weight to be carried by the persons P.

In one embodiment, the method further comprises, after the step of disposing the columbarium 30 on the columbarium bed 106, releasably attaching the columbarium 30 to the ritual transporter 100. While it is disclosed above that columbarium is attached to columbarium bed 30, it could alternately be attached to side rails 102, 104 or to any other suitable structure of transporter 100.

According to the method of the present invention, it is possible to expose the funeral urn 134 on the urn bed 103 to expose the funeral urn externally and separately from the columbarium 30 during a ritual procession.

By consequently allowing the transportation of lightweight columbarium 30 on a ritual transporter 100, the persons involved in the funeral ritual of a deceased person can themselves carry the columbarium and the funeral urn to the funeral ground.

Another way to take advantage of the lightweight columbarium 30 is that it may be shipped and transported with a crate 200 as shown in FIGS. 6-9 and installed on a base 32 directly from crate 200, which installation is facilitated by using a prop 202.

More particularly, crate 200 comprises a rigid protective shell 204 attached to the columbarium 30 externally thereof for protecting the columbarium 30 against impacts. Rigid shell 204 comprises two shell portions 206, 208 each composed of a number of panels in the form of planks, that are attached to each other by means of shell panel attachments securing the shell panels against the columbarium. The shell panel attachments include flexible straps 210, 212 that are wrapped around the two shell portions 206, 208 to hold them against columbarium 30.

Shell 204 is made from a shell material comprising one or more of wood and plastic; although any rigid, impact-resistant preferably light-weight material would be acceptable.

The two shell portions 206, 208 of shell 204 define an opening 214 that is aligned with the bottom of the columbarium 30 when shell 204 is installed on columbarium 30.

Prop 202 is also formed of a few planks assembled together, and is sized to fit within the shell opening 214 so as to abut against the underface of bottom wall 70 of columbarium 30 and to protrude beyond the shell 204, for allowing columbarium 30 to rest on prop 202 when prop 202 rests on the ground, while shell 214 is then positioned spacedly over ground, for facilitating egress of the columbarium from crate 200 and installation of the columbarium on base 32 as detailed hereinafter.

According to the present invention, a method of installing on base 32 the lightweight columbarium 30 stored in crate 200 is disclosed. The method comprises the steps of: providing a prop 202 sized to fit within the shell opening 214 and being thicker than the shell 204; placing prop 202 on base 32; placing columbarium 30 stored in the crate 200 on prop 202 such that the bottom of the columbarium, i.e. the underface of bottom wall 70, rests on prop 202, with the prop extending through the opening 214 in the crate 200 and protruding beyond the shell 204; removing the shell 204 from the columbarium 30 at least partly while the columbarium rests on the prop; and removing prop 202 from underneath the columbarium 30 to have columbarium 30 rest directly on base 32.

The step of removing shell 204 from columbarium 30 comprises removing the two shell portions 206, 208, each including a few shell panels in the form of e.g. assembled (e.g. nailed) wooden planks, by releasing the shell panel attachments in the form of flexible straps, e.g. by cutting them with scissors, that secure the shell panels against the columbarium 30. It is understood that any number of shell panels could form shell 204, either in the form of the two depicted shell portions 206, 208, or more generally otherwise in any suitable shell panel arrangement to cover and protect the columbarium against impacts.

Prop 202 consequently helps to remove the shell panels from the columbarium by providing a rest for spacing columbarium 30 above base 32 such that the shell 204 itself would be spaced above base 32, to allow 210, 212 and the shell panels to be removed without the weight of the columbarium 30, nor the weight of the crate 200 itself, resting on the shell panels.

Figures 10, 11:
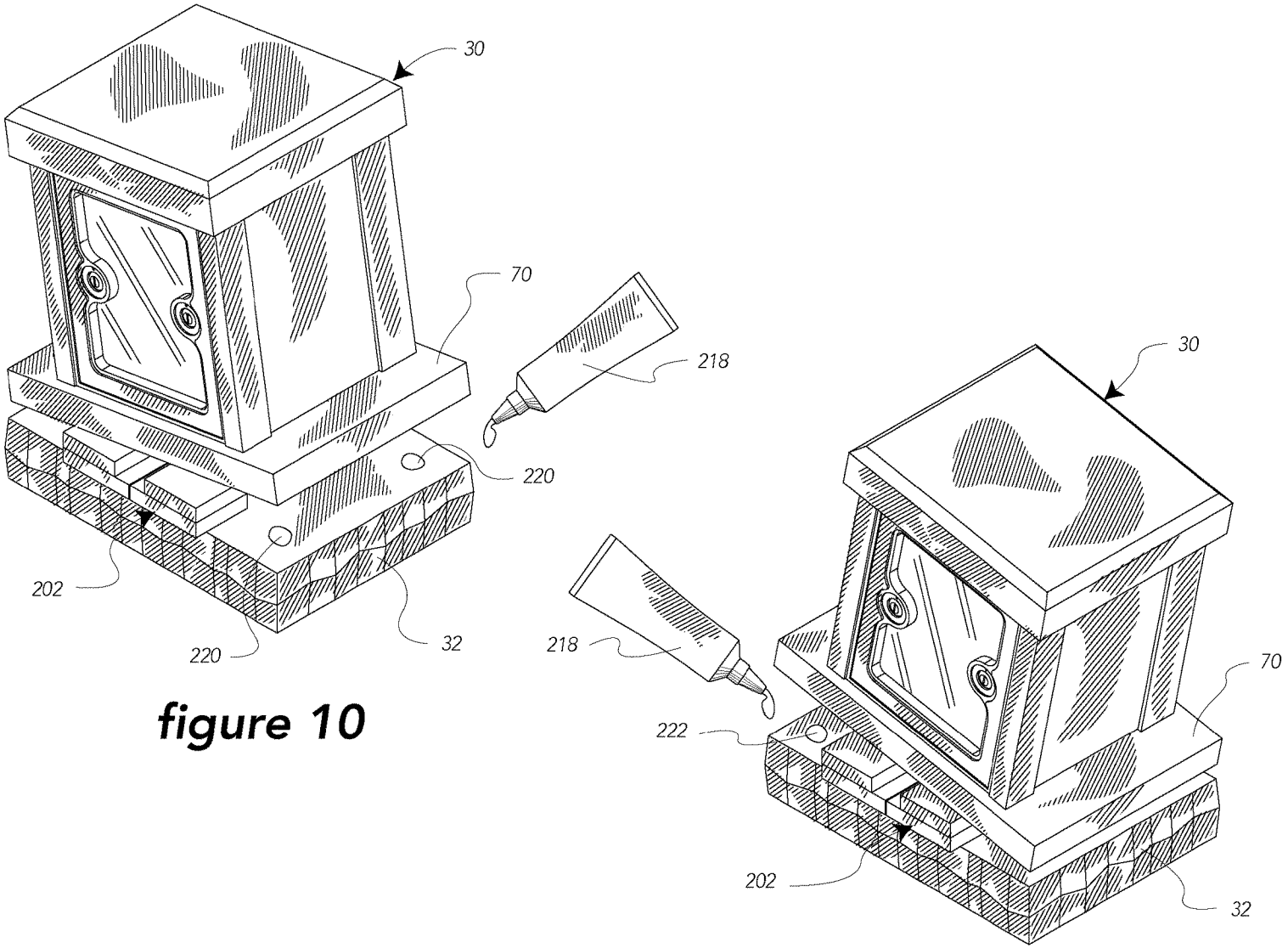
Figure 12:
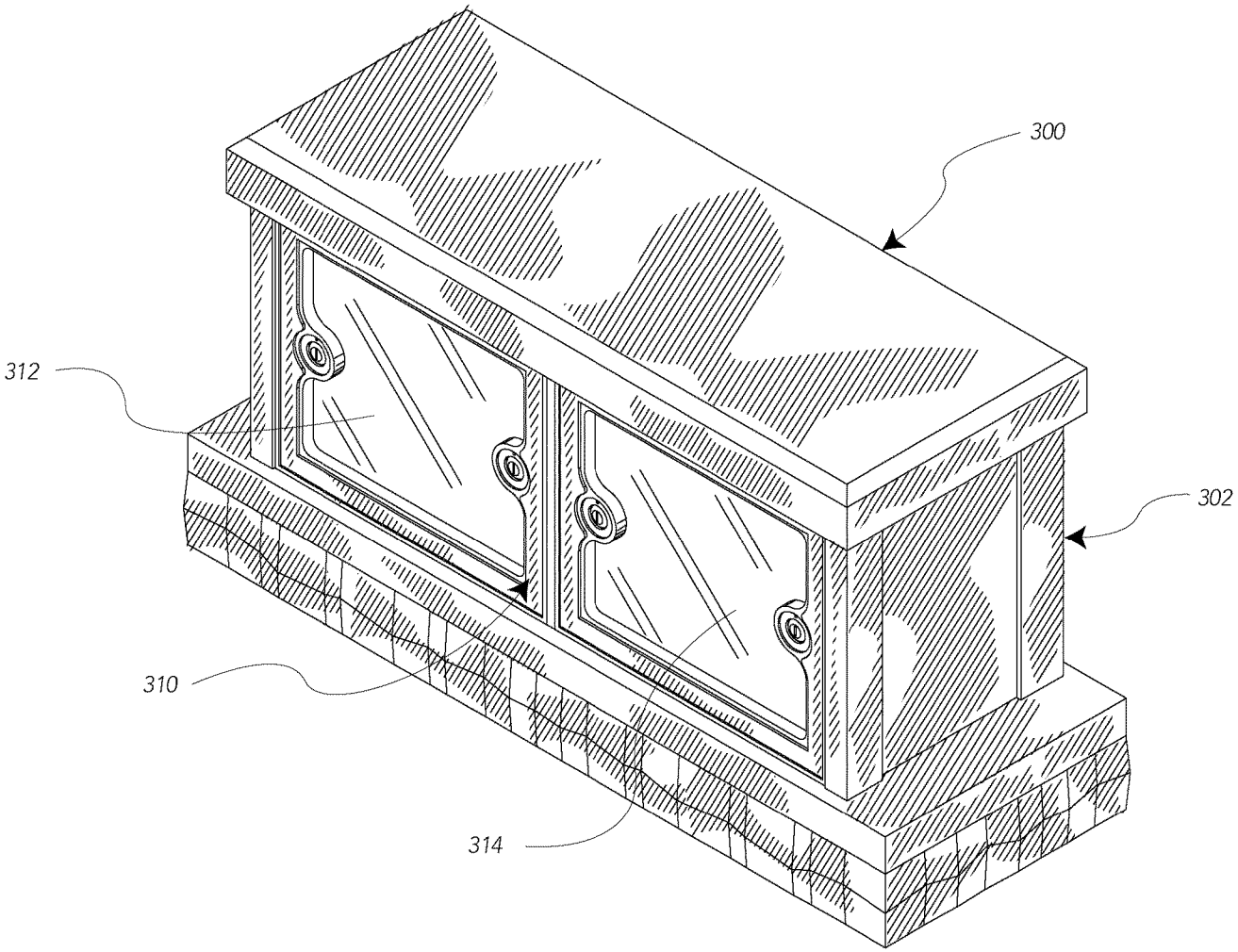
FIGS. 12 and 13 are respectively a perspective view and an exploded perspective view of the columbarium according to a second embodiment of the present invention, mounted on a base.
Figure 13:
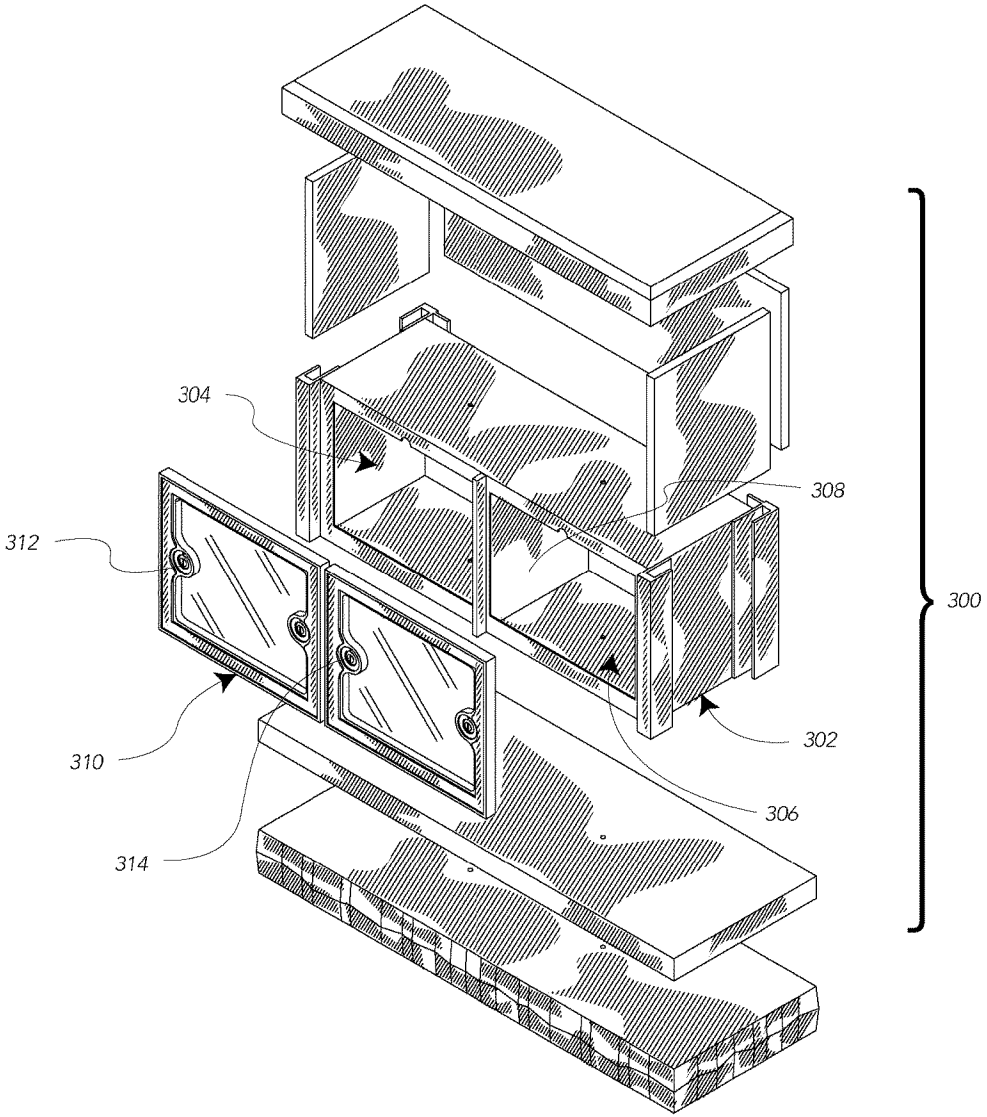
Figure 14:
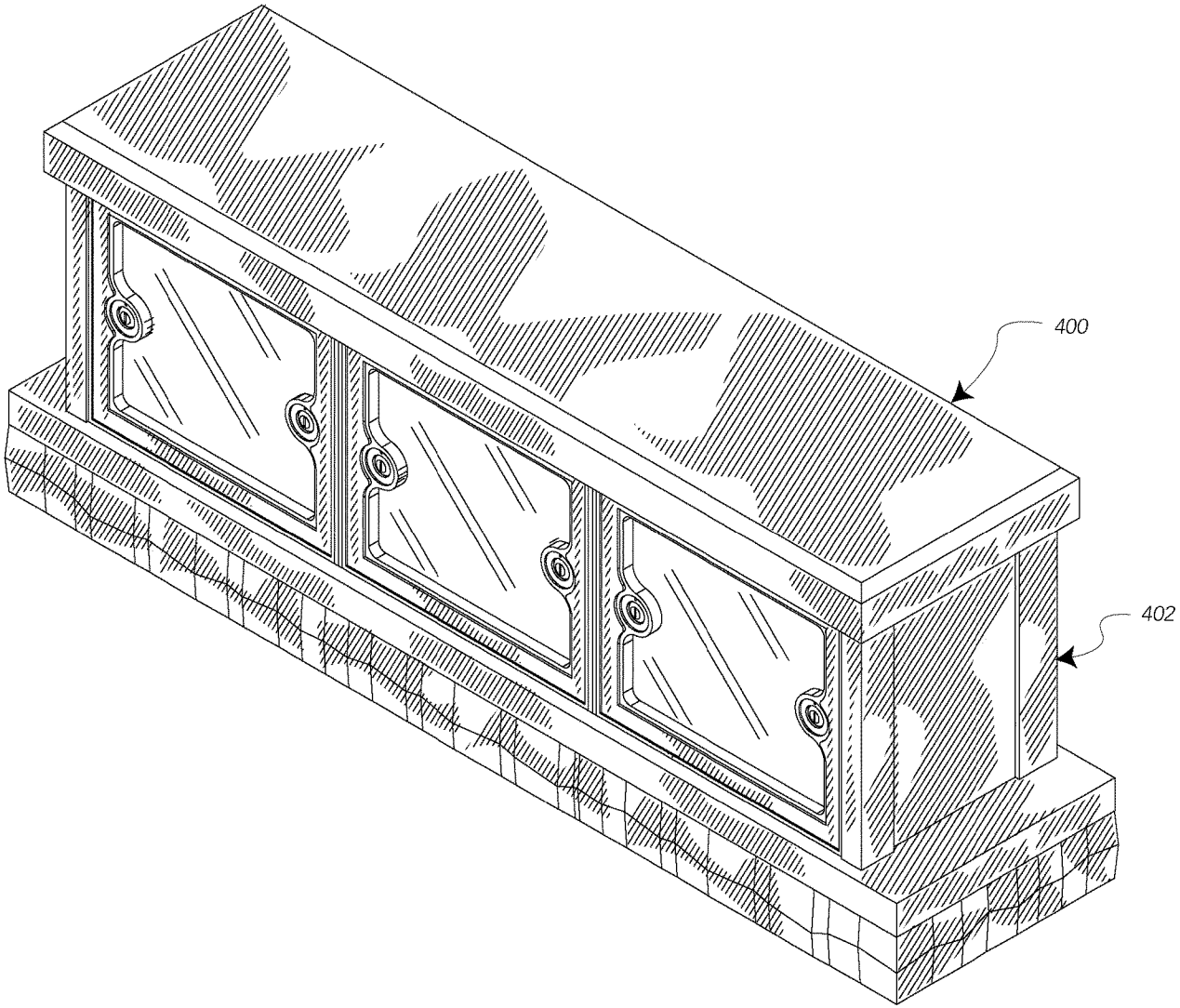
FIGS. 14 and 15 are respectively a perspective view and an exploded perspective view of the columbarium according to a third embodiment of the present invention, mounted on a base.
Figure 15:
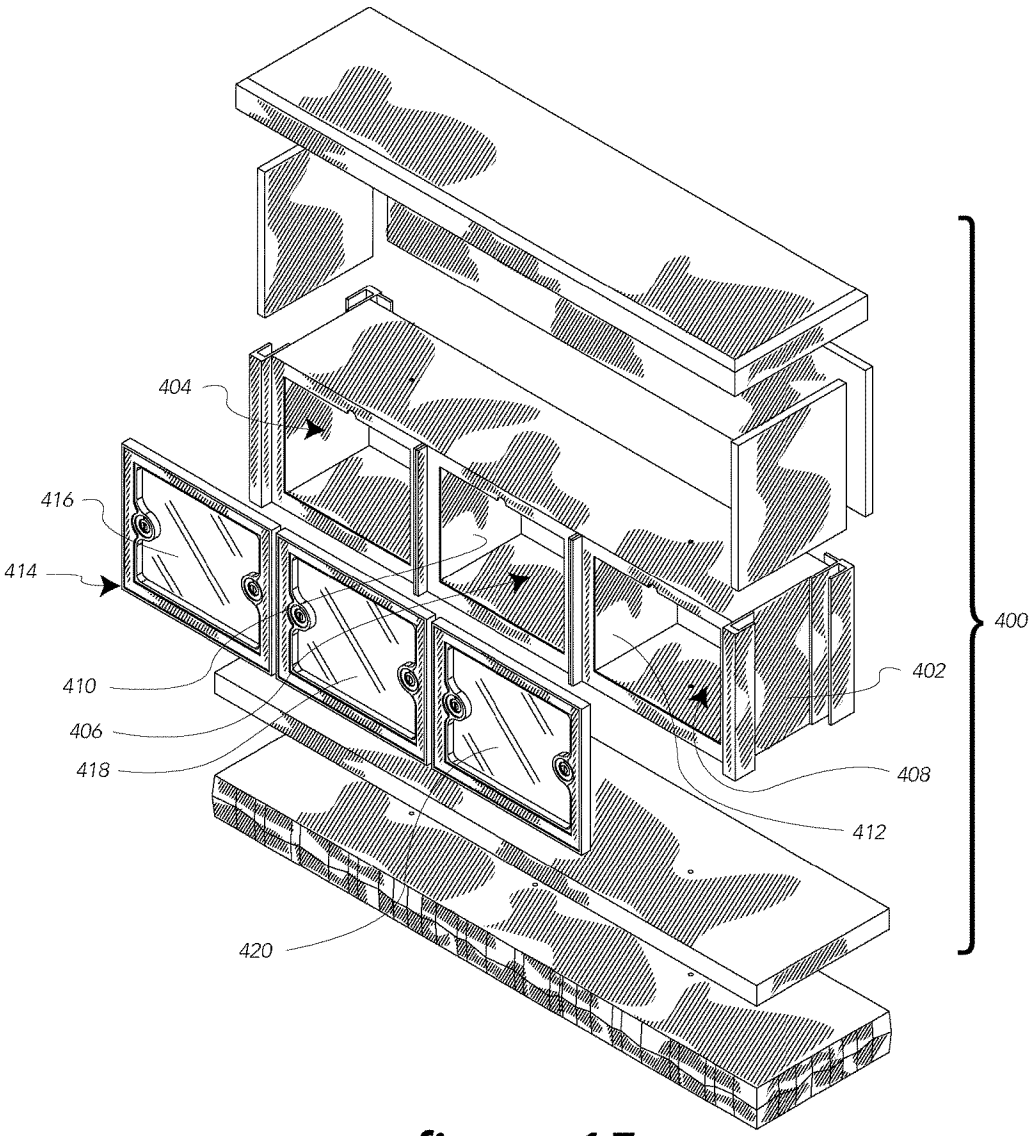

Before the step of removing prop 202 from underneath the columbarium 30, the method comprises rocking the columbarium on one side until the bottom of the columbarium rests on the base and the weight of the columbarium is removed from the prop, as shown in FIG. 11. By rocking the columbarium in this way, its weight is removed from prop 202 and prop 202 can be easily removed.

The method of the present invention also includes to fix columbarium 30 to base 32 with an adhesive 218. More particularly, after the step of removing the shell 204 but before the steps of rocking the columbarium on one side and of removing the prop, the method includes the steps of rocking the columbarium on another side opposite the one side as shown in FIG. 10, until access to the bottom of the columbarium is obtained; and applying a first portion 220 of adhesive 218 between the base and the bottom of the columbarium while the columbarium is rocked on the other side; then, before the step of removing the prop from underneath the columbarium but after the step of rocking the columbarium on the one side: applying a second portion 222 of adhesive 218 between the base and the bottom of the columbarium while the columbarium is rocked on the one side, as shown in FIG. 11.

It can consequently be understood that in addition to prop 202 facilitating the removal of crate 200 as explained above, prop 202 has a second purpose: it also facilitates the installation of adhesive by allowing the columbarium to be rocked on one side and the other over prop 202, to expose the underface of bottom wall 70 and/or the corresponding surface on base 32, to apply adhesive between the two. Although shown to be applied on the base 32, the adhesive could obviously be applied under columbarium bottom wall 70 instead.

Figure 6:
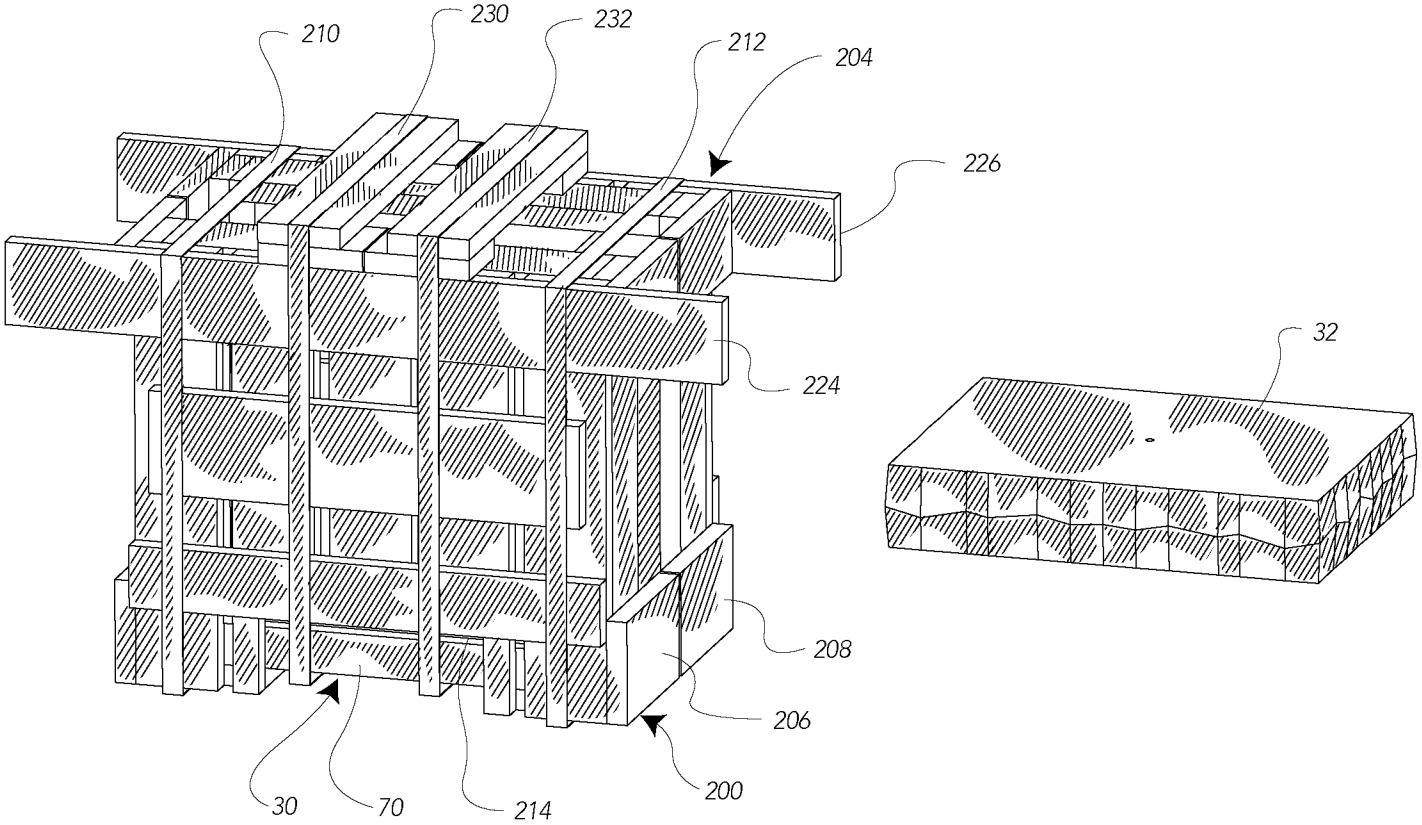
FIGS. 6-11 are perspective views of the columbarium and base of FIGS. 1-2, together with a crate and a prop according to the present invention, showing the columbarium stored in a crate and separate from the base on which it is to be installed in FIG. 6 and then sequentially showing the installation of the columbarium on the base and its removal from the crate in FIGS. 7-11 using the prop to help in this process.
Figure 7:
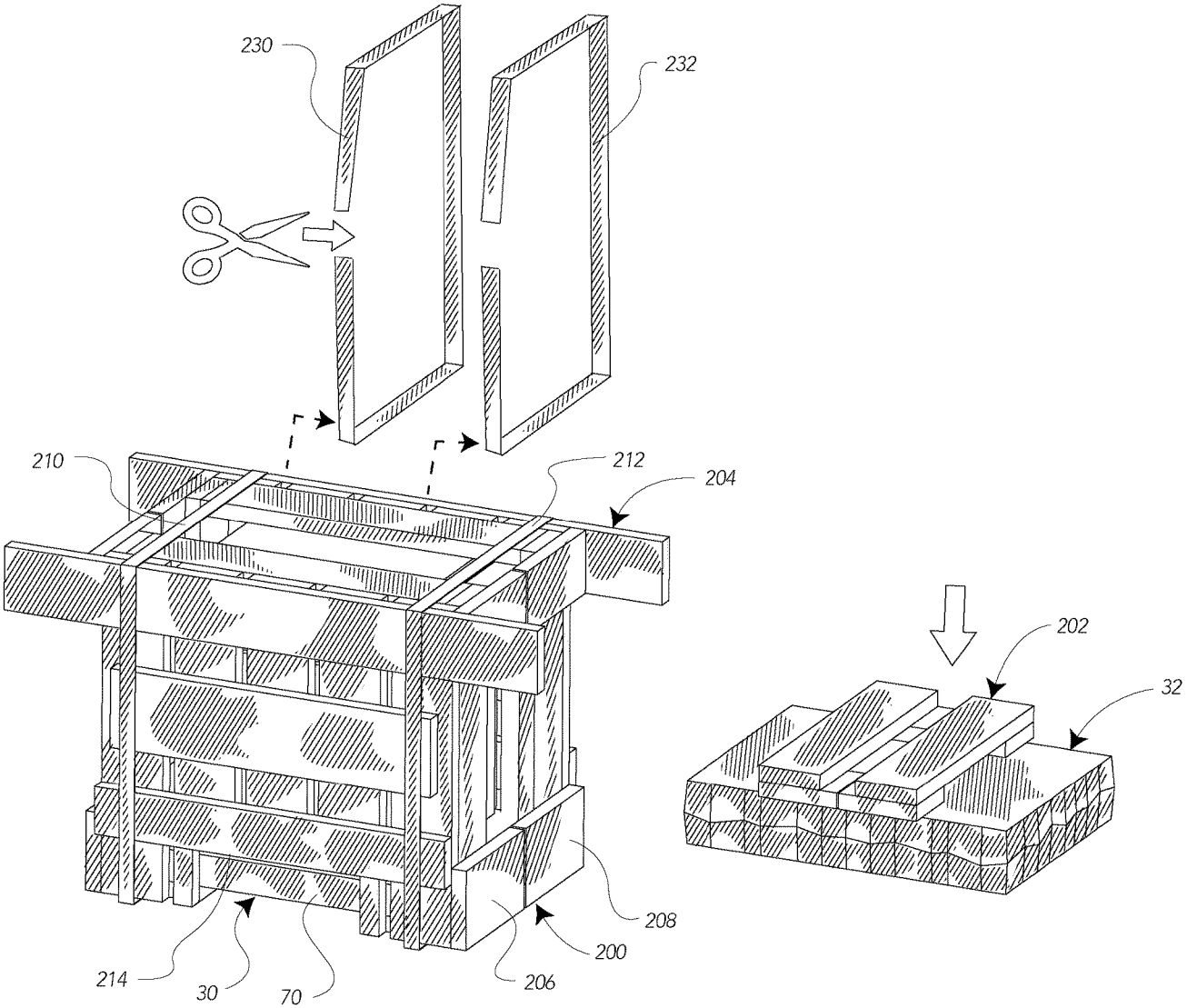
Figure 8:
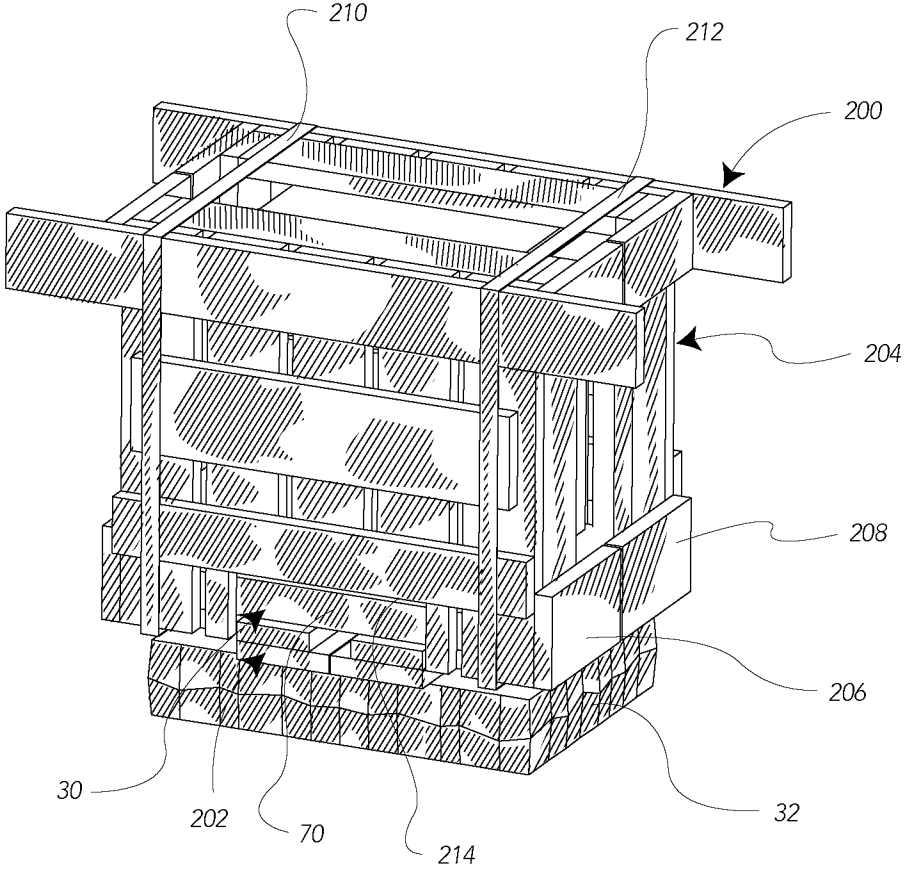
Figure 9:
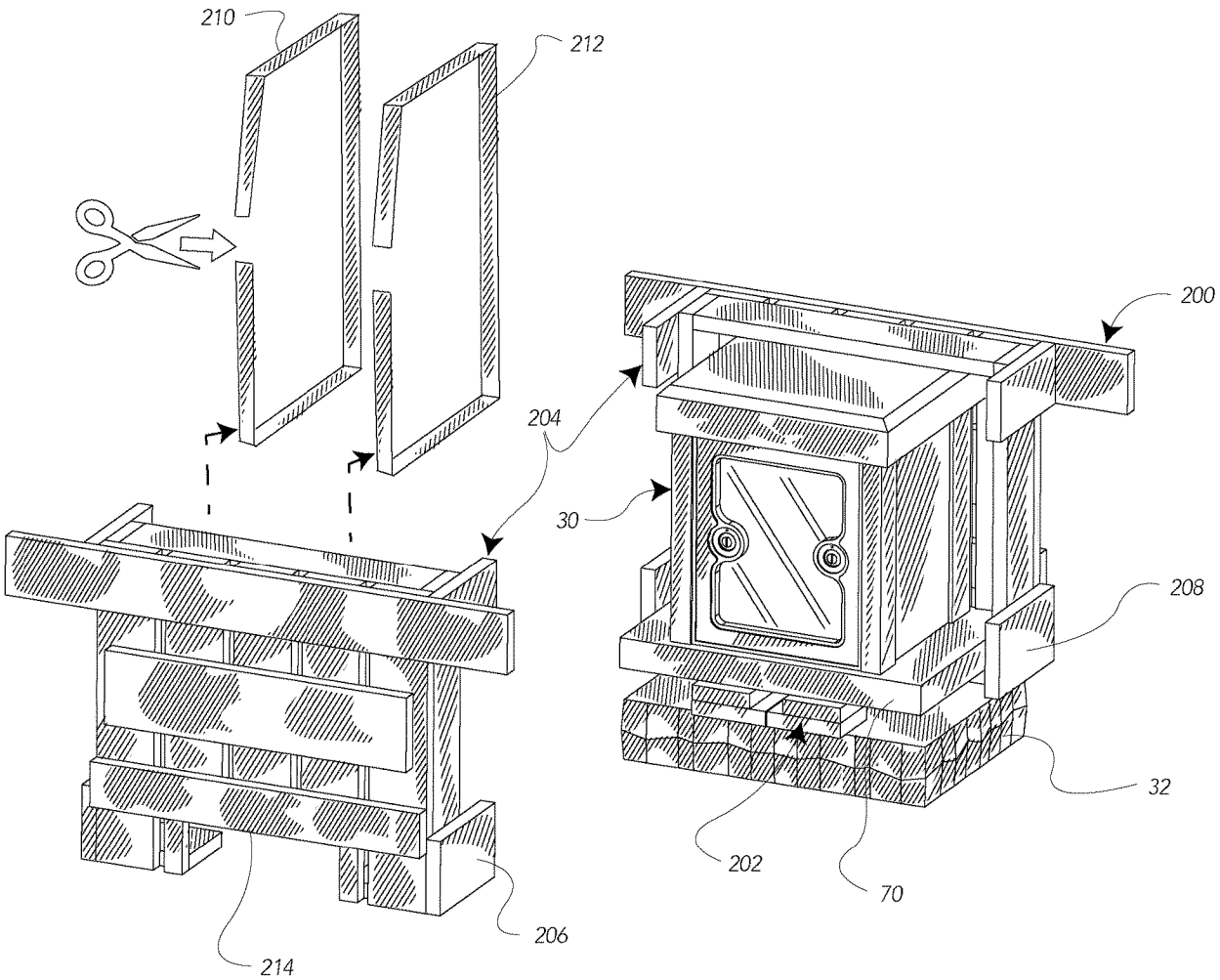

Prop 202 is preferably shipped and transported with crate 200, for example it can be attached to crate 200 with flexible straps 230, 232 and removed with scissors as shows in FIGS. 6 and 7.

Shell 204 preferably comprises handles 224, 226 respectively provided on shell portions 206, 208 in the form of planks protruding from each shell portion 206, 208 that can be manually grasped for transportation.

Transporting the columbarium 30 in manually transportable crate 200 is made possible by the light weight of columbarium 30 as described above.

FIGS. 12-13 and 14-15 respectively show a second and a third alternate embodiments of columbariums 300 and 400 according to the present invention, that are similar to the first embodiment 30 of FIGS. 1-2 except as described hereinafter and as will be obvious to someone skilled in the art.

The second embodiment shows that columbarium 300 includes a frame 302 that has two enclosures 304, 306 therein, with a middle wall 308 separating the two enclosures 304, 306. The front wall 310 includes two doors 312, 314 that can be opened independently.

The third embodiment shows that columbarium 400 includes a frame 402 that has three enclosures 404, 406, 408 therein, with two middle walls 410, 412 separating the three enclosures 404, 406, 408. The front wall 414 includes three doors 416, 418, 420 that can be opened independently.

Columbariums 300, 400 can respectively house two and three funeral urns, each enclosed in its own enclosure. Although they are larger in size than the columbarium 30 of the first embodiment, they are considerably lighter in weight than conventional double or triple columbariums that are exclusively made of stone, marble or granite.

The invention claimed is:

1. In combination, a lightweight columbarium, a crate and a prop, the lightweight columbarium defining a top and a bottom and comprising:

a rigid columbarium frame made of a frame material;

a number of decorative panels made of a decorative panel material;

panel attachments for attaching the decorative panels to the rigid columbarium frame; and an enclosure defined within said decorative panels and said rigid columbarium frame, for receiving a funeral urn, with the rigid columbarium frame material being less fragile than the decorative panel material and allowing the rigid columbarium frame to provide structural rigidity to the lightweight columbarium at less weight than if only the decorative panel material were used;

the crate comprising:

a rigid protective shell attached to the lightweight columbarium externally thereof for protecting the lightweight columbarium against impacts; and an opening provided in the rigid protective shell that is aligned with the bottom of the lightweight columbarium; wherein the prop is sized to fit within the rigid protective shell opening so as to abut against the bottom of the lightweight columbarium and to protrude beyond the rigid protective shell, for allowing the lightweight columbarium to rest on the prop when the prop rests on the ground for facilitating egress of the lightweight columbarium from the crate and installation of the lightweight columbarium on a base.

2. The combination of claim 1, wherein the rigid protective shell comprises a number of shell panels and shell panel attachments securing the shell panels against the lightweight columbarium.

3. The combination of claim 1, wherein the rigid protective shell is made from a shell material comprising one or more of wood and plastic.

* * * * *